US011118885B2

(12) United States Patent
Williamson et al.

(10) Patent No.: US 11,118,885 B2
(45) Date of Patent: Sep. 14, 2021

(54) ON-DEMAND HIGH CAPACITY AND SPEED PORTABLE PART OR CONSUMABLE ITEM CARRIER AND BELT FEED SYSTEM

(71) Applicant: The United States of America as represented by the Secretary of the Navy, Crane, IN (US)

(72) Inventors: Christopher Williamson, Bloomfield, IN (US); Lawrence Shirley, Bloomfield, IN (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 62 days.

(21) Appl. No.: 14/750,195

(22) Filed: Jun. 25, 2015

(65) Prior Publication Data

US 2016/0313104 A1 Oct. 27, 2016

Related U.S. Application Data

(60) Provisional application No. 62/151,774, filed on Apr. 23, 2015.

(51) Int. Cl.
*F41A 9/79* (2006.01)
*F42B 39/02* (2006.01)
(Continued)

(52) U.S. Cl.
CPC ..... *F42B 39/02* (2013.01); *B25C 3/002* (2013.01); *F41A 9/79* (2013.01); *F42B 39/08* (2013.01);
(Continued)

(58) Field of Classification Search
CPC ..... F41A 9/29; F41A 9/61; F41A 9/79; F42B 39/00; F42B 39/02; F42B 39/08
(Continued)

(56) References Cited

U.S. PATENT DOCUMENTS 661,201 A * 11/1900 Name not available . F41A 9/79 89/34
2,710,561 A * 6/1955 Dowd ..... F41A 9/79 206/3

(Continued)

OTHER PUBLICATIONS

Merrill, David, "Backpack Belt-Fed: The TYR Tactical MICO", Dec. 15, 2014, Recoil, all pages, <http://www.recoilweb.com/backpack-belt-fed-the-tyr-tactical-mico-54859.html>, retrieved May 30, 2017.*

(Continued)

*Primary Examiner* — Jonathan C Weber
(74) *Attorney, Agent, or Firm* — Naval Surface Warfare Center, Crane Division; Christopher A. Monsey

(57) ABSTRACT

A portable item carrier and belt feed system is provided along with related methods. One illustrative embodiment includes a carrier and feed structure comprising a semi-rigid material with a divider support extending perpendicularly from a center floor section of the carrier. A belt of items is folded over the divider to reduce jams or misfeeds as the belt of items is pulled through a feed chute near an upper side section of the carrier and feed structure at a predetermined range of feed angles to the divider support. A latch disposed on a lid of the feed structure is configured for quick and easy access to the belt of items. A flexible outer container encloses the carrier and feed structure and can be coupled to a harness section configured to couple with a mobile structure. Additional embodiments include variants suitable for field manufacturing as well as portable manufacturing systems and methods.

21 Claims, 12 Drawing Sheets

(51) Int. Cl.

| | |
|---|---|
| ***F42B 39/08*** | (2006.01) |
| ***F42B 39/26*** | (2006.01) |
| ***B25C 3/00*** | (2006.01) |
| *A45F 3/04* | (2006.01) |
| *A45F 3/10* | (2006.01) |

(52) U.S. Cl.
CPC ..... *F42B 39/26* (2013.01); *A45F 3/10* (2013.01); *A45F 2003/045* (2013.01)

(58) Field of Classification Search
USPC ..... 89/33.2, 33.01, 33.1, 33.14
See application file for complete search history.

(56) References Cited

U.S. PATENT DOCUMENTS 2,895,382 A * 7/1959 Starry ..... F41A 9/54 89/34
4,393,746 A * 7/1983 Rocha ..... F41A 9/79 89/34
4,610,191 A * 9/1986 Schmid ..... F41A 9/79 89/34
5,253,574 A * 10/1993 Sanderson ..... F41A 23/00 89/33.16
5,263,397 A * 11/1993 Sanderson ..... F41A 23/00 89/33.14
5,471,904 A * 12/1995 Armstrong ..... F41A 9/57 193/25 AC
6,439,098 B1 * 8/2002 Dillon ..... F41A 9/79 89/33.14
6,799,500 B1 * 10/2004 Kulikowski ..... F41A 9/79 89/1.1
7,546,794 B1 * 6/2009 Sarles ..... F41A 9/79 206/3
8,356,539 B2 * 1/2013 Gonzalez ..... F41A 9/34 89/33.14
8,434,397 B1 * 5/2013 Deckard ..... B64D 7/06 89/37.13
8,573,109 B2 * 11/2013 Buechler ..... B64D 7/06 89/33.1
8,800,420 B2 * 8/2014 Simione ..... F42B 39/26 206/3
8,850,950 B2 * 10/2014 Deckard ..... B64D 7/06 89/136
8,863,633 B2 * 10/2014 Gotie ..... F41A 9/34 89/33.14
2008/0264946 A1 * 10/2008 Moschella ..... A45C 13/10 220/326
2013/0206787 A1 * 8/2013 Shiell ..... F42B 39/002 221/279
2013/0319213 A1 * 12/2013 Simione ..... F42B 39/26 89/34
2014/0263519 A1 * 9/2014 Saucedo ..... A45F 3/08 224/633
2016/0116263 A1 * 4/2016 Engmann ..... F42B 39/24 206/3
2016/0313104 A1 * 10/2016 Williamson ..... F42B 39/02

OTHER PUBLICATIONS

Reinert, Bob, "Soldier-inspired Army ammo pack is 'game-changer' on battlefield", May 2012, Designfax, all pages, <http://www.designfax.net/cms/dfx/opens/article-view-dfx.php?nid=4&bid=155&et=featurearticle&pn=02>, retrieved May 30, 2017.*
TYR Tactical, "HURON™ MICO Machine Gunners Pack", Feb. 2, 2012, YouTube, entire video, <https://www.youtube.com/watch?v=yL2Wd-nuiZ4>, retrieved May 30, 2017.*
Reinert, Bob, "'Ironman' a game-changer on battlefield", Oct. 14, 2011, U.S. Army, all pages, <https://www.army.mil/article/67318/_Ironmanan__a_game_changer_on_battlefield/>, retrieved May 30, 2017.*

* cited by examiner

ON-DEMAND HIGH CAPACITY AND SPEED PORTABLE PART OR CONSUMABLE ITEM CARRIER AND BELT FEED SYSTEM

CROSS-REFERENCE TO RELATED APPLICATIONS

The present application claims priority to U.S. Provisional Patent Application Ser. No. 62/151,774, filed Apr. 23, 2015, entitled "ON-DEMAND HIGH CAPACITY AND SPEED PORTABLE PART OR CONSUMABLE ITEM CARRIER AND BELT FEED SYSTEM," the disclosure of which is expressly incorporated by reference herein.

STATEMENT REGARDING FEDERALLY SPONSORED RESEARCH OR DEVELOPMENT

The invention described herein was made in the performance of official duties by employees of the Department of the Navy and may be manufactured, used and licensed by or for the United States Government for any governmental purpose without payment of any royalties thereon. This invention (Navy Case 200,227) is assigned to the United States Government and is available for licensing for commercial purposes. Licensing and technical inquiries may be directed to the Technology Transfer Office, Naval Surface Warfare Center Crane, email: Cran_CTO@navy.mil.

BACKGROUND AND SUMMARY OF THE INVENTION

The present invention relates to a portable feed system for product or item use with a variety of equipment items. One set of embodiments include systems related to on-demand high capacity and speed portable part or consumable item carrier and belt feed system. Another set of embodiments relates to portable belt fed ammunition carriers that are human portable, high capacity, permit high speed operation, and reduce or eliminate jams or misfeeds. Some embodiments also permit multiple types of ammunition to be carried in the carrier.

Existing systems for carrying ammunition include ammunition cans and backpack systems. These ammunition carrying systems or cans typically hold relatively few rounds, e.g., two hundred rounds of 7.62, a relatively low amount especially in situations in which rapid weapon fire quickly drains the ammunition cans. Also, ammunition cans are bulky and heavy, e.g. 6 lbs, and an operator of equipment may carry several ammo cans based on the carrier's physique. Items that are bulky and are a heavy burden for an operator of equipment will cause the operator to work inefficiently.

Current backpack ammunition systems also have similar undesirable attributes. For example, a backpack mounted ammunition container made out of steel and/or aluminum is heavy, e.g., weighing over 16 lbs. Existing packs also hold relatively few rounds compared to an embodiment of the invention, e.g., about five hundred rounds of 7.62. These existing backpack systems are also costly, e.g., around $4,000 or higher in material cost. Moreover, existing backpack systems have a long lead time in manufacturing, e.g., forty-five to sixty days. In comparison to existing ammunition carrying systems, one embodiment weighs significantly less, e.g. about 9 lbs, almost a 50% weight reduction, has greater ammunition capacity, e.g. at least 650 rounds of 7.62, costs less to construct, e.g. $300 in material costs, has a shorter lead time in manufacturing, e.g. one day, and utilizes a single belt of ammunition which reduces jams and misfeeding by smooth ammunition feeding and reduced reloading. Also, the embodiment can be comprised of lightweight, flexible material that, when pinched, crushed, jostled or otherwise positioned in less than optimum positions, the belt of items contained inside can conform and adjust in ways a rigid metal unyielding ammo can simply cannot.

Further, existing systems are bulky and heavy because each ammunition can must have its own feed adapter, feed system built in for smooth dispensing, and individual container to hold the rounds. This creates additional weight and bulkiness due to inefficient ways of packing multiple cans. In a firefight, the ammunition can's bulkiness contributes to awkwardness and time consumption because each ammunition can must be removed from the weapon when empty, placed in a drop bag, and then a new can is connected to the weapon by correctly fitting the feed belt into place before the weapon can be charged and fired. The embodiment solves this problem by providing several hundred rounds in one lighter single container that is ergonomically fastened to a back pack.

Equipment operators, particularly in mobile settings, typically need items quickly dispensed to complete missions by allowing operators to be agile and adaptable in changing environments. Furthermore, heavy existing backpack systems burden an individual's hips. Ergonomically, heavy backpack carrying systems are a very inefficient way to carry portable items or use them rapidly.

According to an illustrative embodiment of the present disclosure, an on-demand high capacity and speed portable part or consumable item carrier and belt feed system is provided. The illustrative embodiment includes a carrier and feed structure comprising a non-metallic semi-rigid material with a divider extending perpendicular from a floor of said carrier and feed structure. A belt of items is folded over the divider to reduce jams or misfeeds as the belt of items is pulled through a feed chute near the top of the carrier and feed structure. A latch disposed on a lid of the feed structure is configured to engage a latch attachment point for quick and easy access to the belt of items. A flexible outer container encloses the carrier and feed structure. The flexible outer container is coupled to a backpack section configured to couple with a mobile structure. The embodiment permits high capacity, high speed operation, and reduces or eliminates jams or misfeeds during service of the belt of items.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

The embodiments of the invention described herein are not intended to be exhaustive or to limit the invention to precise forms disclosed. Rather, the embodiments selected for description have been chosen to enable one skilled in the art to practice the invention.

One exemplary embodiment of the invention provides an extremely light and ergonomic carrier and feed system. In some embodiments, a carrier and harness or strap assembly provides a system that permits a carrier or user to support weight on a carrier or user's back, eliminating a need to carry any cans on any other part of an operator's body and reducing weight onto the operator's hips. An exemplary frame used with embodiments of the invention can be made from aluminum, other lightweight metal alloy, or reinforced synthetic polymers or plastic and can be equipped with structures, such as a harness or system of straps and tautly-stretched netting, which prevents contact between the frame and an operator or user's back. Centralizing weight onto the operator' back also provides a better center of gravity for a mobile operator. An exemplary embodiment provides high capacity which reduces or eliminates a need for frequent reloading or pauses between replenishment of items or consumables in a feeding system. Various aspects of the invention also permit a significant reduction in weight.

In some embodiments, an operator can load parts or consumable items, e.g., 7.62 mm ammunition, into an exemplary carrier and feed system, connect one or more feed chutes and attach a feed chute, e.g. standard issue metal structure for protecting ammunition during use, to an equipment item which utilizes items or consumables, e.g., a MK 48 weapon system. A carrier or operator then slings the exemplary carrier and feed system on their back and performs their mission. Operators or carriers also have an option of mounting the carrier and feed system pack to a backpack frame.

Figure 1:
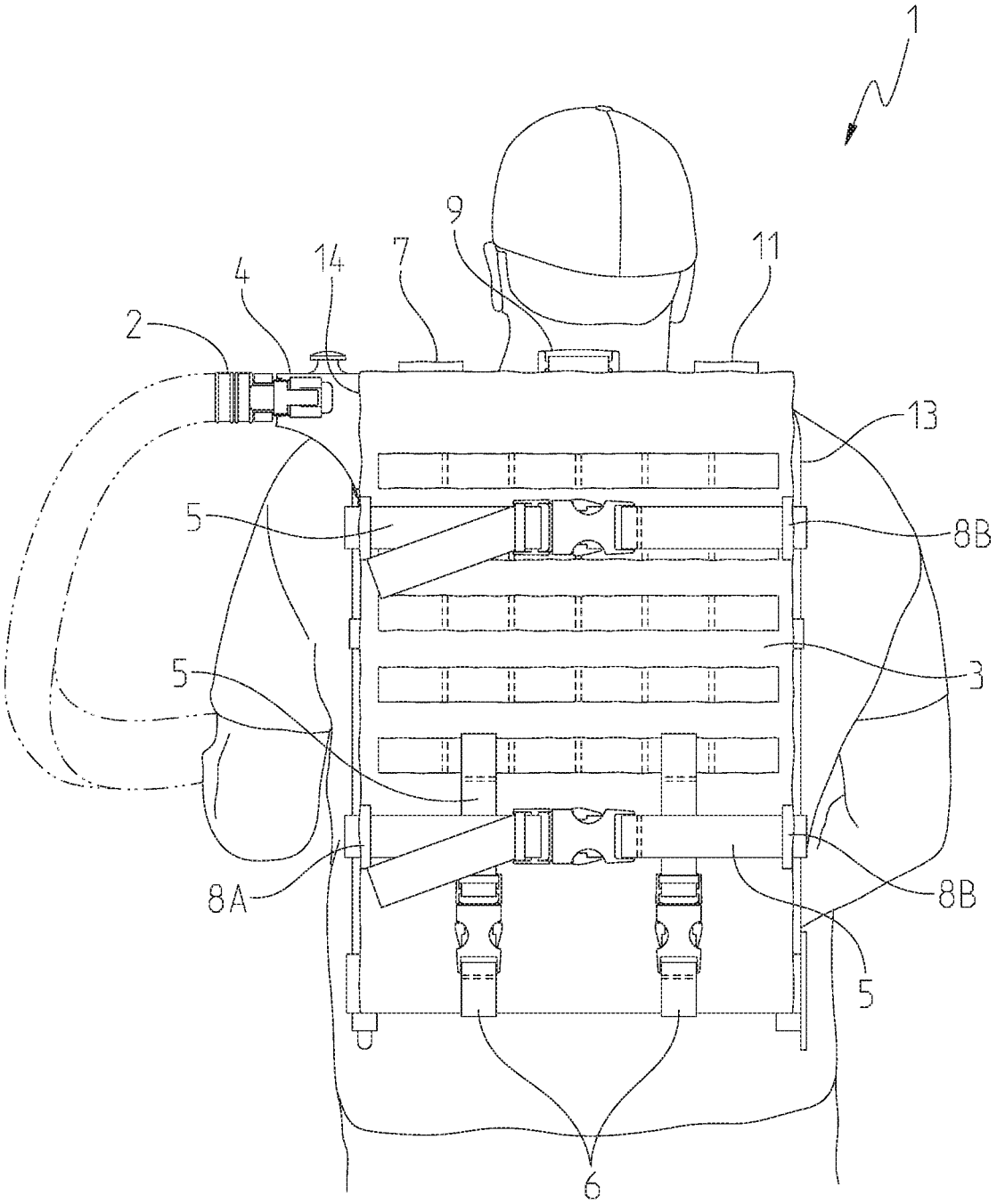
FIG. 1 shows a rear view of an exemplary carrier and feed system in accordance with one embodiment of the invention from a perspective of an observer viewing a back side of an operator wearing the system.

FIG. 1 shows an external rear view of an exemplary carrier and feed system such as a high capacity portable ammunition feed and carrier system. A flexible outer container 3 contains a carrier and feed structure 19 (not shown, see FIG. 3) which includes a feed chute adapter 4 that couples with a feed chute 2 that conveys at least one flexible belt of items or consumables such as ammunition cartridges (not shown). A plurality of upper frame straps 5 are provided which pass through mounting loops 8A and 8B fastened to the flexible outer container 3 and couple the flexible outer container 3 to a backpack frame 13 which in turn is coupled with shoulder backpack straps 17 (not shown) that permit, for example, a mobile structure, e.g. human, robot, horse, vehicle, moveable object with or without propulsive capability, etc. to carry the high capacity portable feed and carrier system 1. A system can also be designed to be interoperable with fixed sites as well as being suitable for immediate use in a mobile application. A plurality of lower frame straps 6 (not visible, see FIG. 8) are also coupled with the flexible outer container 3 that attach with the backpack frame 13. A top section of the flexible outer container 3 is closed over the carrier and feed structure 19 by means of Velcro® straps 7, 11 and quick release couplers, e.g., push-snap clips, 9 which closes the top section over the carrier and feed structure 19 while permitting rapid access to its top section for loading, etc. The flexible outer container 3 has a feed chute adapter opening 14 on one side that permits the feed chute adapter 4 to extend out of the flexible outer container 3.

Figure 2:
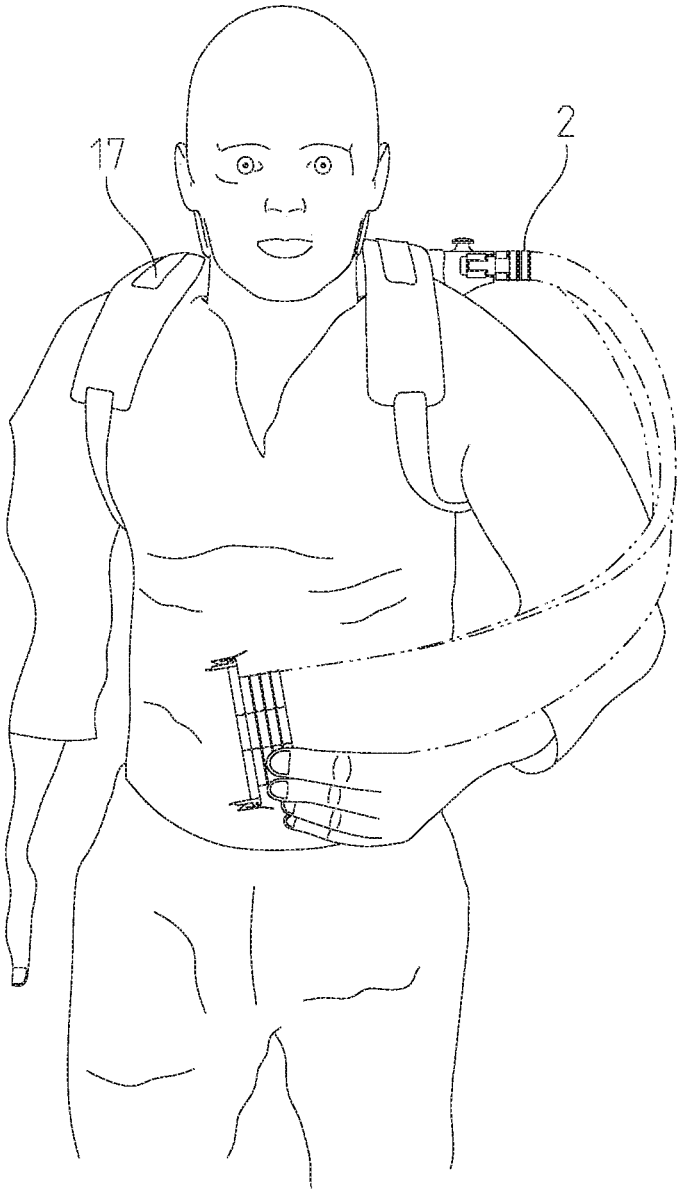
FIG. 2 shows a front view of an operator with an exemplary carrier and feed system along with an exemplary feed chute used with various embodiments of the invention.

FIG. 2 shows a front view of a user/operator with an exemplary carrier and feed system 19 (not visible) along with an exemplary feed chute 2 used with various embodiments of the invention. Shoulder straps 17 couple with the backpack frame 13 (not visible). The feed chute 2 is routed around in an arc so that it can couple with an equipment item, e.g., weapon, in a user operational orientation such that the feed chute has an arc which reduces or eliminates binding or friction within the feed chute for items or consumables that are belt fed through the feed chute 2. Prior to loading the carrier and feed structure 19 with items or ammunition, the belt of items or ammunition (not shown) is placed inside the carrier and feed structure 19 and then slid through the feed chute 2 by hand before the belt of items or ammunition is attached.

Figure 3:
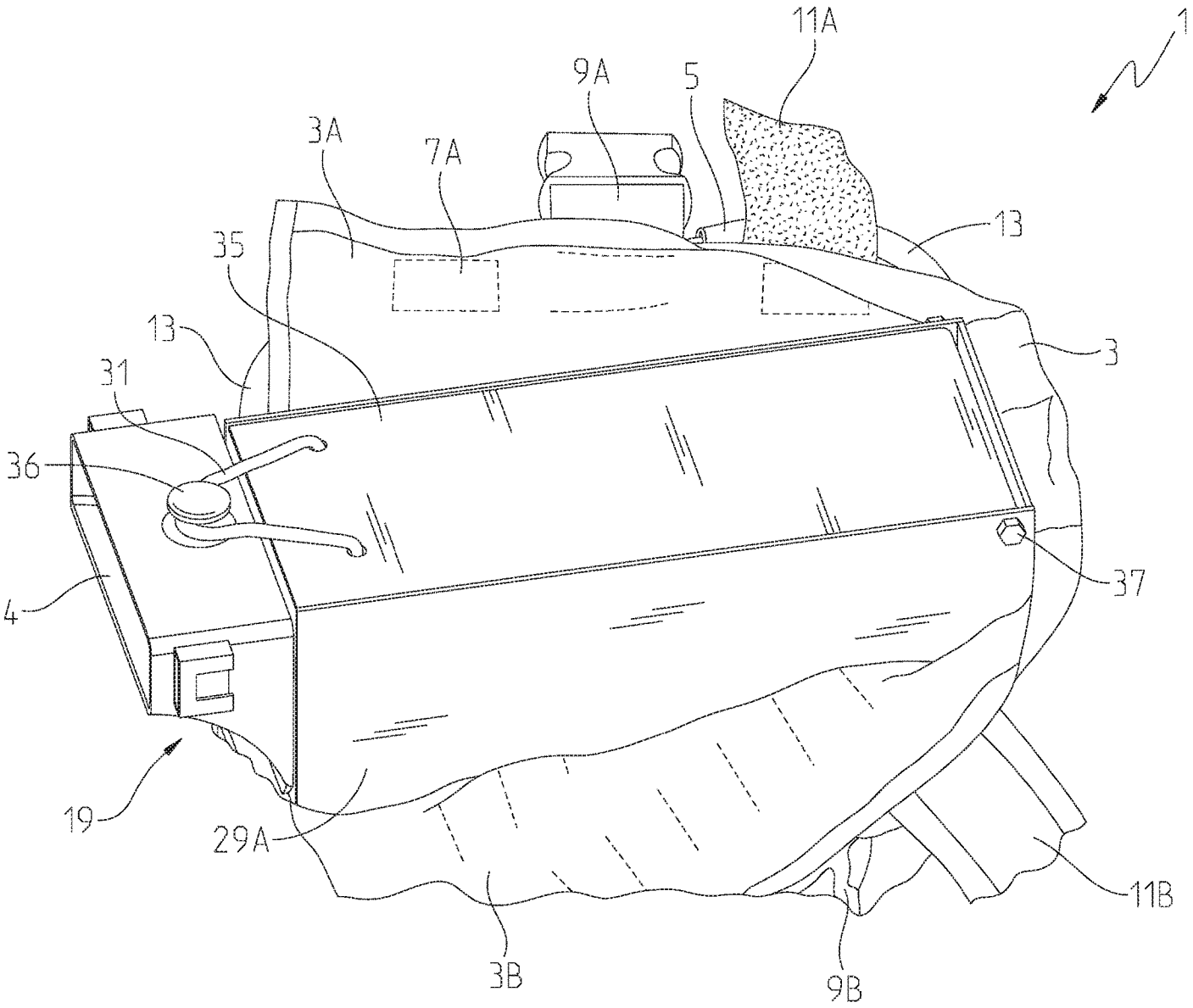
FIG. 3 shows a perspective top view of an exemplary carrier and feed system inside a flexible outer container in accordance with one embodiment of the invention.

FIG. 3 shows a perspective top view of an exemplary carrier and feed system in accordance with one embodiment of the invention. The flexible outer container 3 contains a carrier and feed structure 19 which includes the feed chute adapter 4 that couples with the feed chute 2 that conveys at least one flexible belt of items or consumables such as ammunition cartridges (not shown). Feed chute adapter 4 provides a means to connect feed chute 2 (not shown) using quick release connectors (e.g., tension clips that lock into ears or vice versa) that permit rapid removal/attachment of the feed chute 2. Feed chute adapter 4 provides a ruggedized interface on the carrier and feed structure 19 which is resistant to force applied to the feed chute 2 and resists being ripped off, crushed, etc. such that it maintains a specific orientation with regard to the carrier and feed structure 19 and in this case ensures flexible belt of items or consumables feed laterally out of the carrier and feed structure 19 into the feed chute 2. The flexible outer container 3 can be made from canvas, heavy duty fabric, Kevlar®, carbon fiber, rip stop fabric, Cordura®, flame resistant heavy duty fabric, or a combination thereof. Some fabrics can be selected to blend with expected surroundings or have electromagnetic spectrum absorptive properties such as infrared absorptive or barrier properties. Upper frame straps 5 (only one is visible in this view) are provided which pass through mounting loops 8A, 8B (not shown, see FIG. 1) fastened to the flexible outer container 3 and couple the flexible outer container 3 to the backpack frame 13 which in turn is coupled with shoulder backpack straps 17 (not shown, FIG. 2) that permit, for example, mobile structure(s), e.g. human, robot, etc. to carry the high capacity portable ammunition feed and carrier system 1. Two top section flaps 3A, 3B of the flexible outer container 3 are shown as open, revealing the carrier and feed structure 19 and are secured together by means of Velcro® straps 7A, 7B (not shown) and 11A, 11B and a quick release coupler, e.g., push-snap clips, 9A, 9B which closes the top section flaps 3A, 3B over a top of the carrier and feed structure 19 while permitting rapid access to its top section for loading, checking for item or ammunition amount, etc. The flexible outer container 3 has a feed chute adapter 4 on one side that permits the feed chute adapter to extend out of the flexible outer container 3. The carrier and feed structure 19 has a lid 35 which is pivotally coupled with the carrier and feed structure on one end via a hinge 37. An exemplary hinge 37 can be formed from, e.g., a carriage bolt, passing through holes on opposing sides of the carrier and feed structure 19 on one end. The hinge 37 also passes through a hinge attach structure 35A of the lid 35 (not visible, see FIG. 6) that is attached on one end of the lid 35. The lid 35 also has a quick release latch 31 on an opposing side from the hinge 37 which releasably couples one side of the lid 35 with the body of the carrier and feed structure 19. In this embodiment, a lid quick release attachment point 36 is coupled to an upper side of the feed chute adapter 4. In this embodiment, the quick release catch is a head of a carriage bolt which has a lip which engages with the quick release latch 31. In this embodiment, the quick release latch 31 is an elastic cord which provides tension and a closing force on the lid 35 so as to maintain the lid in a closed position and thereby assist in containing items or consumables within the carrier and feed structure 19, permitting rapid, simple, and ruggedized capability for opening and re-securing of the lid under high stress, reduced manual dexterity, or rapid operation conditions. An operator can wear gloves and use the latch for example. Tabs (not shown) can be added to the latch 31 which then provide additional gripping options for the latch 31. The carrier and feed structure 19 is formed from side walls, one of which is noted by 29A, which form a loading opening which is covered by the lid 35.

Some embodiments of the carrier and feed structure 19 include sections or parts that are made out of lightweight semi-rigid materials such as, e.g., thermoplastic materials such as Kydex®. Other materials that can be used which can be made with desired properties e.g., semi-rigid properties, include, thermoplastic acrylic-polyvinyl chloride materials. For example, a system can include lightweight semi-rigid material made from an acrylic-polyvinyl chloride composite engineered for thermoforming fabrication, and combines properties of both the acrylic and the polyvinyl chloride components. From acrylic, this exemplary lightweight semi-rigid material obtains rigidity and formability; from PVC, toughness, chemical resistance and good interior finish ratings. Sheet thickness ranges from 0.028 to 0.500 and can be thermoformed, post formed, brake formed and laminated. An exemplary thermoplastic or lightweight semi-rigid material can also have, e.g., a modulus of elasticity in flexure of about 330,000 psi; be rigid and will see moderate deformation when loaded. Some embodiments can have such lightweight semi-rigid materials formed with relatively thin wall sections and in some cases a relatively hard thermoplastic with a hardness of 90 on the Rockwell R scale. Some lightweight semi-rigid materials can have hardness combined with a grained surface that can increase its abrasive resistance. Some lightweight semi-rigid material can have low flammability, UL 94 classification V-0.

Such lightweight semi-rigid material allows manufacturing a strong and flexible but somewhat rigid or lightweight semi-rigid design that eliminates a need for conventional fabrication materials such as steel and aluminum. Such thermoplastic materials can be made in a field setting using aluminum forms and heat guns, screws, and a modified feed chute connection. Lightweight or semi-rigid material can be also somewhat flexible that permits a limited degree of flex in the carrier structure from belt fed items or consumables as they are manipulated or drawn from the carrier which contributes to a reduction of jams or misfeeds and provides a substantial reduction of noise and wear during operation. In other words, when an exemplary carrier and feed structure is crushed, jostled, or otherwise positioned in less than optimum positions, the belt of items inside can conform and adjust to each contortion from operation, loading, or construction, e.g., in a field environment. An embodiment also includes a divider coupled on opposing ends to a bottom and both side sections of the carrier with such lightweight or semi-rigid material made out of, e.g., Kydex®, that allows items or consumables in, e.g., a linked belt configuration, to droop over it at a middle section, decreasing or eliminating feed jams. A feed chute is provided on an upper side section further reducing a potential for jams allowing for an improved feed orientation to a system using the items or consumables.

Figure 4:
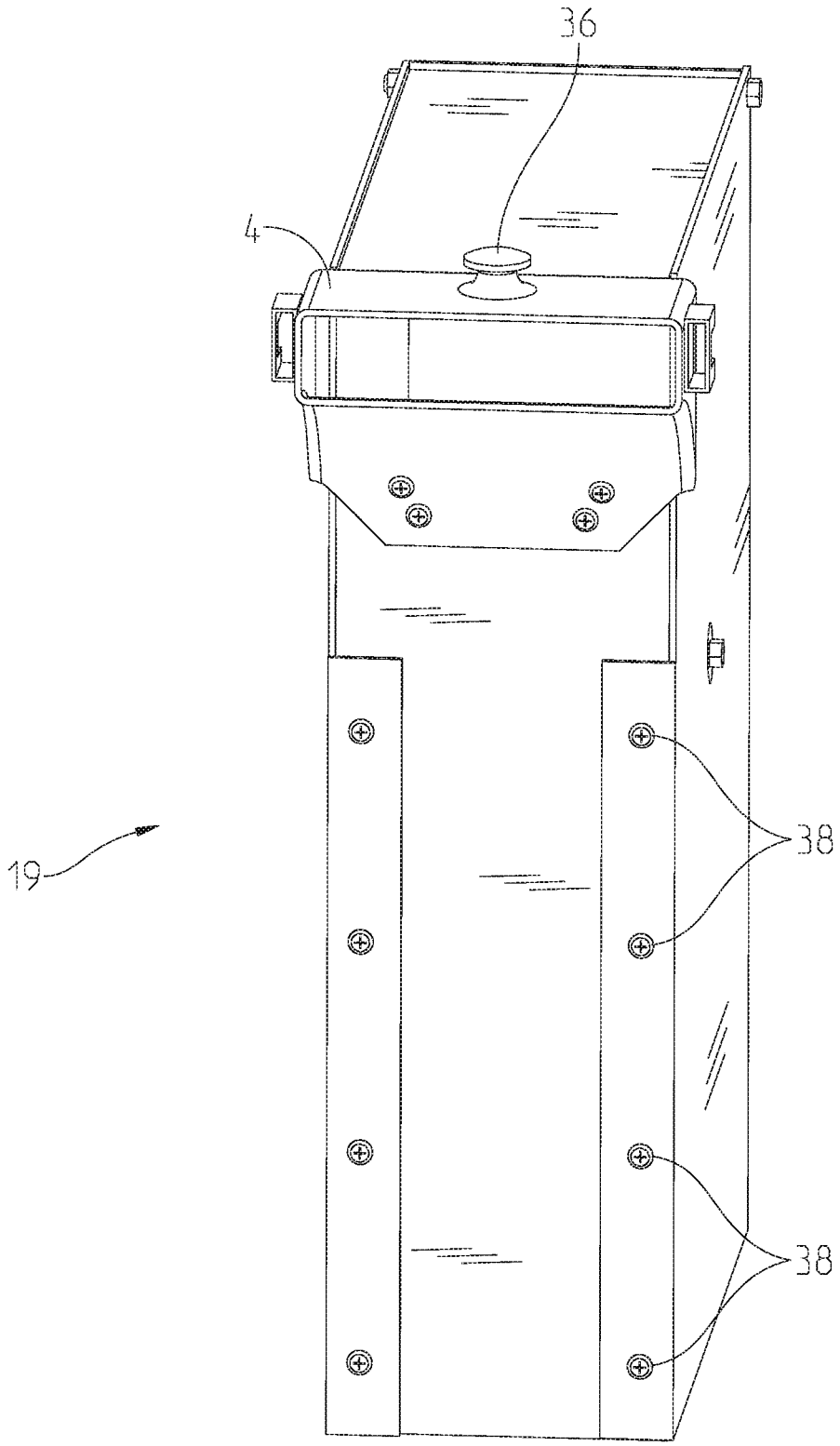
FIG. 4 shows a perspective side view of an exemplary carrier and feed system in accordance with one embodiment of the invention.

FIG. 4 shows a perspective side view of an exemplary carrier and feed system in accordance with one embodiment of the invention. Sections of the carrier and feed structure 19, such as end sections, are secured in this exemplary embodiment using fasteners 38, such as screws 38 (e.g., Chicago screws) etc. which have a tool engagement section on a first end (e.g. Philips head screwdriver) and are smooth or flat on an opposing end (e.g., inside the carrier and feed structure 19) which prevent catching of items or consumables within the carrier and feed structure 19. Rivets or grommets provide alternative embodiments for fasteners 38. An end of the feed chute adapter 4 is shown with the quick release attachment point 36. In this view, the carrier and feed structure 19 top is shown as open with the lid 35 in an open position (not visible).

Figure 5:
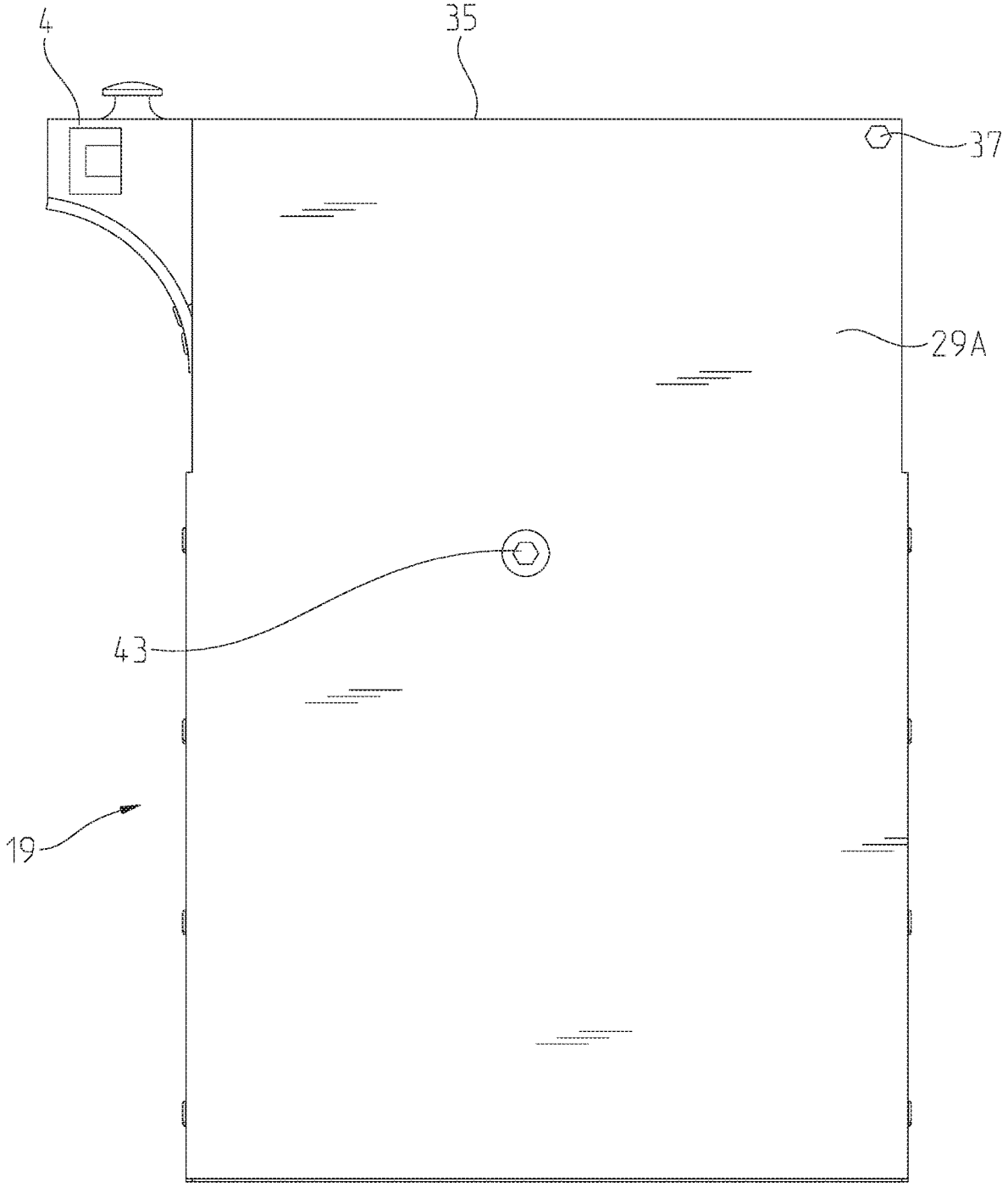
FIG. 5 shows a side view of an exemplary carrier and feed system in accordance with one embodiment of the invention.

FIG. 5 shows another side view of an exemplary carrier and feed system in accordance with one embodiment of the invention. The carrier and feed structure 19 is shown with side wall 29A, lid 35 shown in a closed position with its securing hinge 37, and a divider securing bolt 43 that passes through side wall 29A and side wall 29A's opposing side wall 29B (not shown) of the carrier and feed structure 19 which fixes one end of a divider structure (not shown) which is positioned within the carrier and feed structure 19. A side view of the feed chute adapter 4 is shown.

Figure 6:
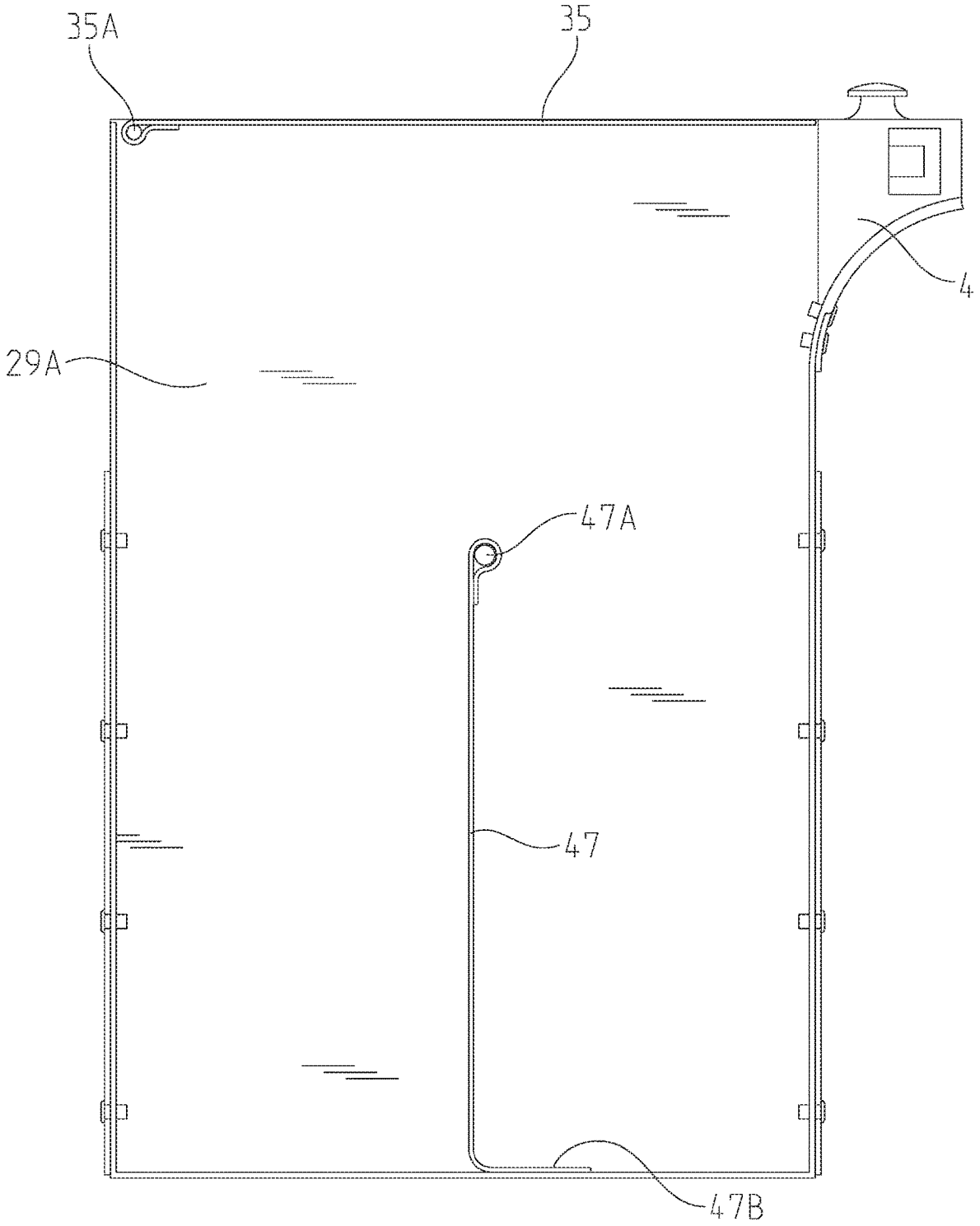
FIG. 6 shows a partially disassembled side view of an exemplary carrier and feed system in accordance with one embodiment of the invention.

FIG. 6 shows a partially disassembled side view of an exemplary carrier and feed system in accordance with one embodiment of the invention. Carrier and feed structure 19 is shown with one side wall 29B removed with lid 35 shown in a closed position. The lid 35 is shown with its hinge attach structure 35A on one end of the lid which hinge 37 (not shown) passes through. Feed chute adapter 4 is shown on one side of the carrier and feed structure 19 which is positioned to receive an exemplary flexible belt of items or consumables. The divider structure 47 is shown attached on one end to a floor of the carrier and feed structure 19 with a foot section 47B that couples to the carrier and feed structure 19 using a fastener, e.g. Velcro® or a bolt on one end and a divider attach structure 47A (e.g., a folded over section of the divider 47 forming a structure adapted to receive the divider securing bolt 43.

Figure 7:
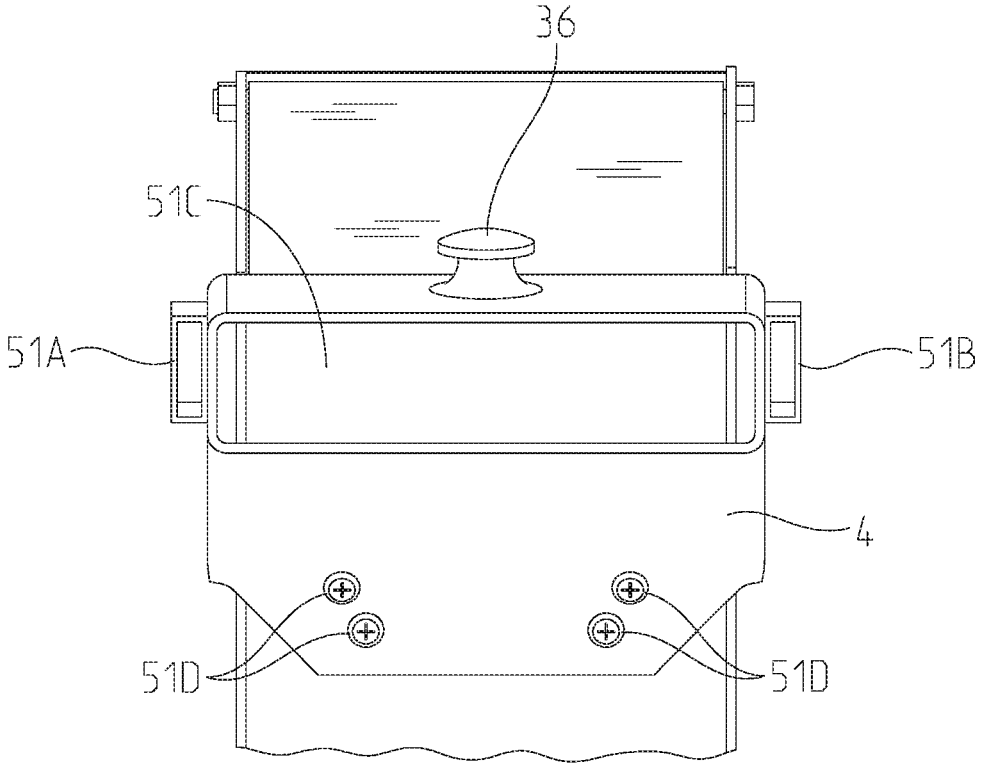
FIG. 7 shows a perspective front view of an exemplary feed chute adapter in accordance with one embodiment of the invention.

FIG. 7 shows a perspective front view of an exemplary feed chute adapter in accordance with one embodiment of the invention. The feed chute adapter 4 is formed with a feed aperture 51C which is shaped in a similar form as exemplary flexible belt or items which pass through it, e.g., rectangular shape which opens at a greater than 90 degree angle to an end side of the carrier and feed structure 19. The feed chute adapter 4 is secured, in this embodiment, to the end side of the carrier and feed structure 19 by means of rivets or screws, e.g., Chicago screws, with an interior that is flat, in this example. The feed chute adapter 4 is formed with a curving interior support structure that is formed to provide a curved lower support to the flexible belt of items or consumables (not shown, see FIG. 10). Lid quick release attachment point 36 is shown on an upper section of the feed chute adapter 4. Feed chute 2 quick release clip ears 51A, 51B, e.g. spring loaded clips that snap on and off, are shown that engage with the feed chute 2.

Figure 8:
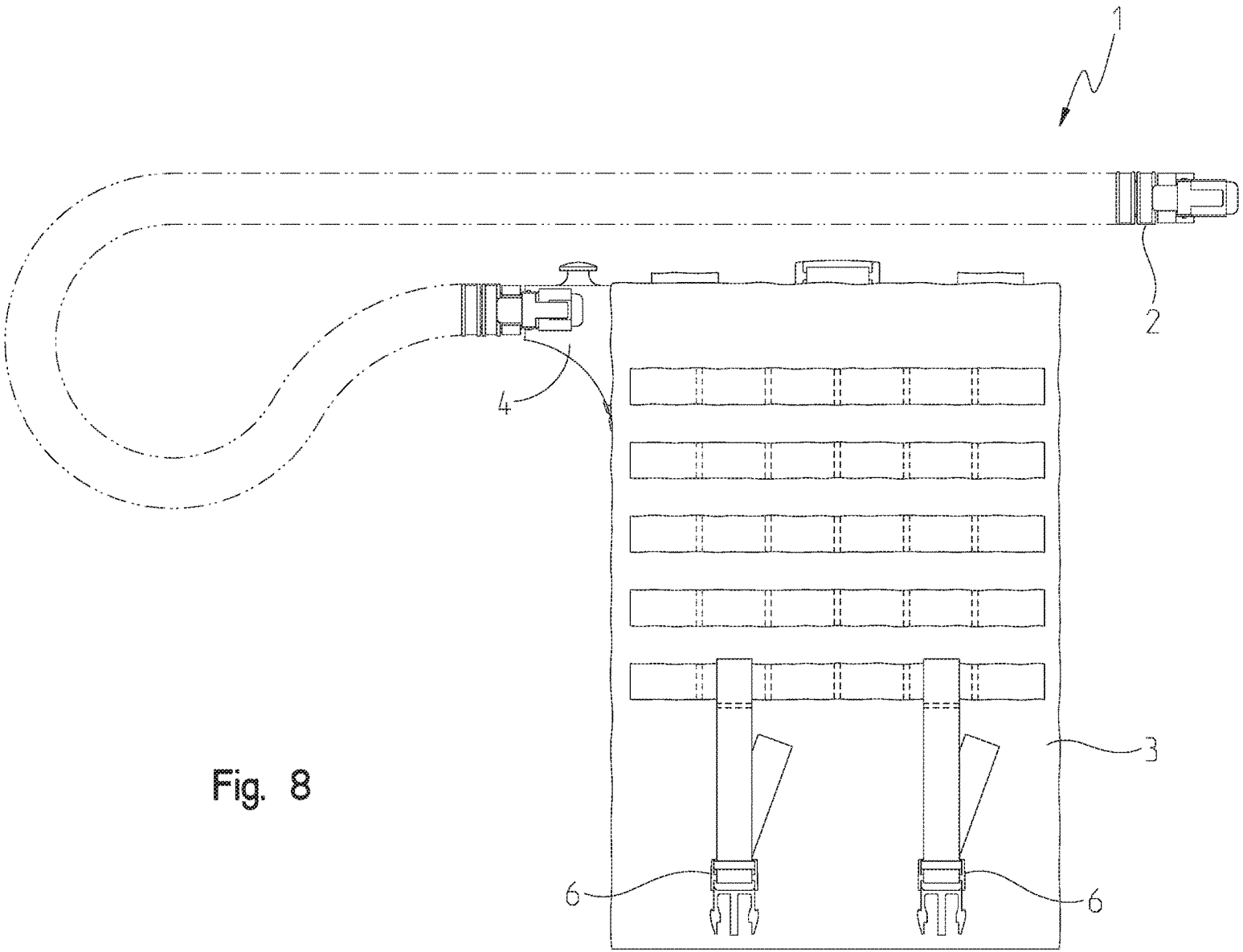
FIG. 8 shows a rear view of an exemplary carrier and feed system in accordance with one embodiment of the invention before a frame is attached from a perspective of an observer viewing a backside of the system.

FIG. 8 shows a rear view of an exemplary carrier and feed system in accordance with one embodiment of the invention before a frame is attached from a perspective of an observer viewing a back facing side of an operator wearing the system. Lower frame straps 6 are shown which couple the flexible outer container 3 to backpack frame 13. Feed chute 2 is shown coupled with feed chute adapter 4.

Figure 9:
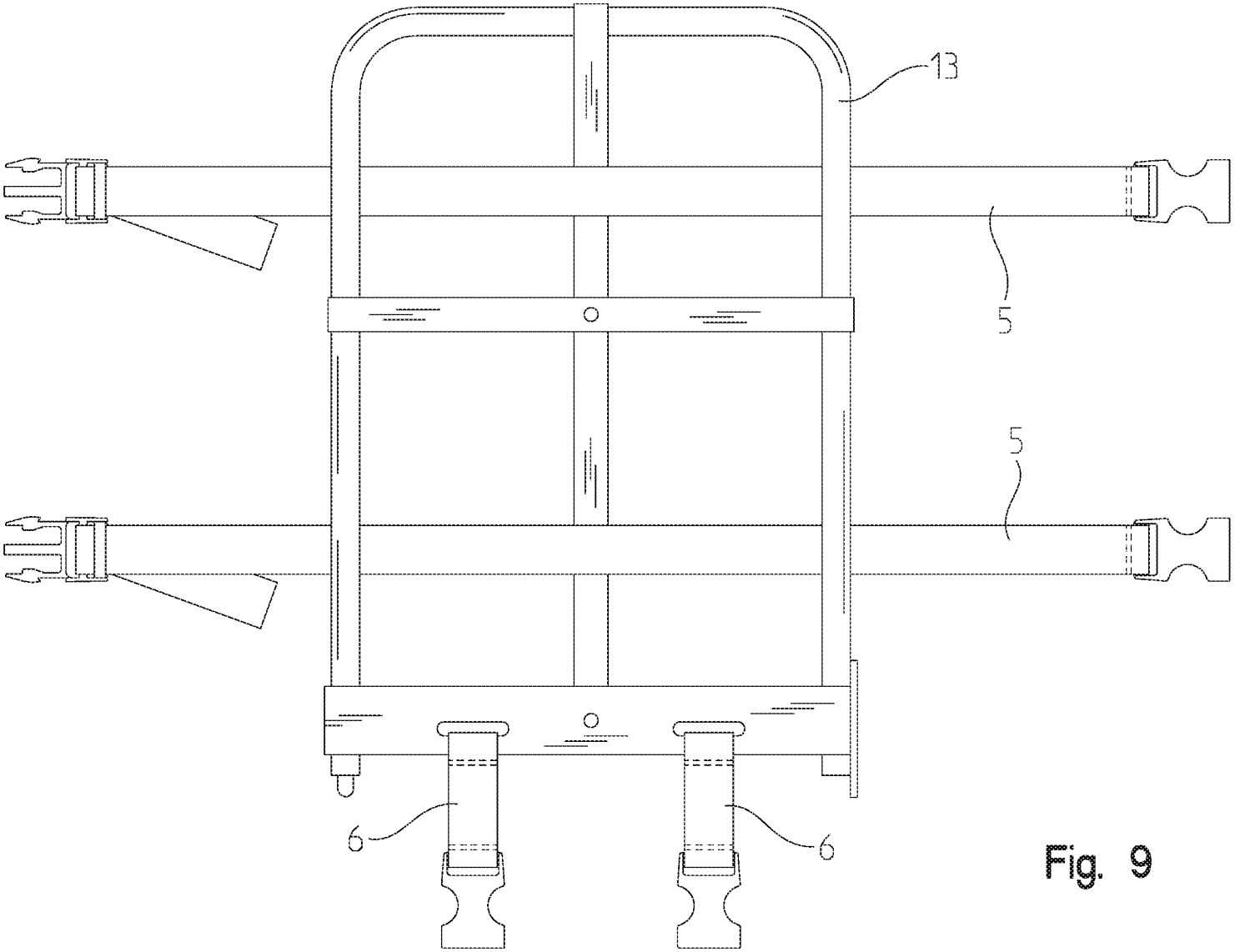
FIG. 9 shows an exemplary frame used with a human portable backpack carrier assembly in accordance with one embodiment of the invention.

FIG. 9 show an exemplary frame 13 used with an assembly in accordance with one embodiment of the invention. Upper frame straps 5 and lower frame straps 6 are shown coupled with the frame 13 along with quick release connectors for each strap.

Figure 10:
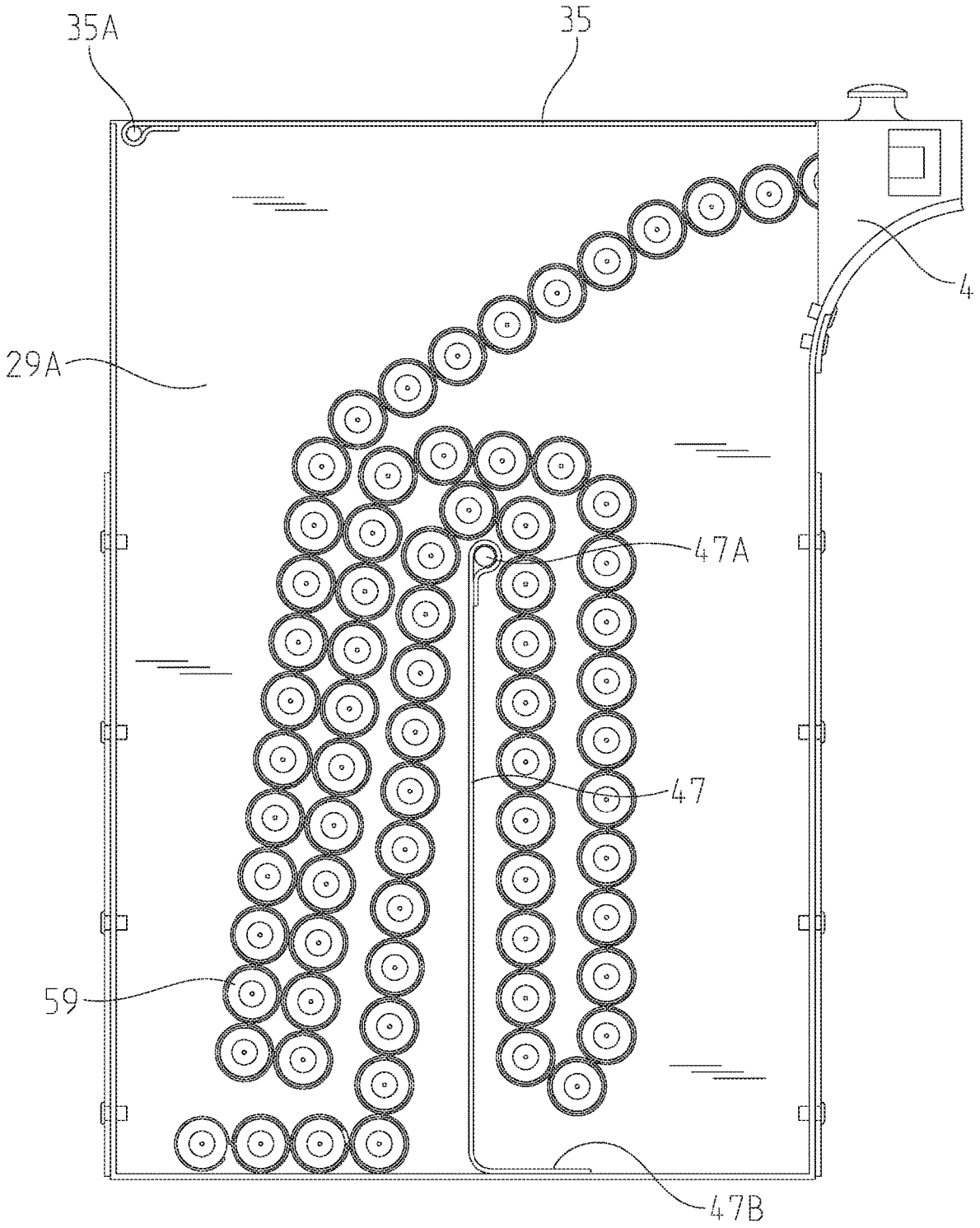
FIG. 10 shows an exemplar carrier and feed system in accordance with one embodiment of the invention illustrating exemplary expendable items such as ammunition positioned within the carrier system.

FIG. 10 shows an exemplar carrier and feed system in accordance with one embodiment of the invention showing exemplary expendable items such as ammunition positioned within the carrier system. Carrier and feed structure 19 is shown with side wall 29B removed with lid 35 shown in a closed position. The lid 35 is shown with its hinge attach structure 35A on one end of the lid which hinge 37 (not shown) passes through. Feed chute adapter 4 is shown on one side of the carrier and feed structure 19 which is positioned to receive an exemplary flexible belt of items or consumables 59. The divider structure 47 is shown attached on one end to a floor of the carrier and feed structure 19 with a foot section 47B that couples to the carrier and feed structure 19 using a fastener, e.g. Velcro® or a bolt on one end and a divider attach structure 47A (e.g., a folded over section of the divider 47) forming a structure adapted to receive the divider securing bolt 43. The flexible belt of items or consumables 59 is supported in an interior middle section of the carrier and feed structure 19 so as to enable folding of the flexible belt of items or consumables 59 so as to support the flexible belt of items or consumables in multiple folds and to position the belt so that it feeds into the feed chute adapter 4 from a more central location within the carrier and feed structure 19. This central feeding orientation of the flexible belt of items or consumables prevents snagging of the belt that occurs when the belt is in a flat folded condition among other things as well as feeding the belt to the feed chute adapter 4 at an angle which generally reduces bend on the belt as it feeds into the feed chute adapter 4. The divider 47 is disposed to a more central feed orientation of the flexible belt of items or consumables 59 at a middle-to-upper section of the carrier and feed structure 19. The divider 47 is held in place by the bolt 43. The divider 47 also provides a spacer function so that the divider is wider than the flexible belt of items or consumables 59 and so contributes to preventing binding of the belt as it dispenses through the feed chute adapter 4.

Figure 11:
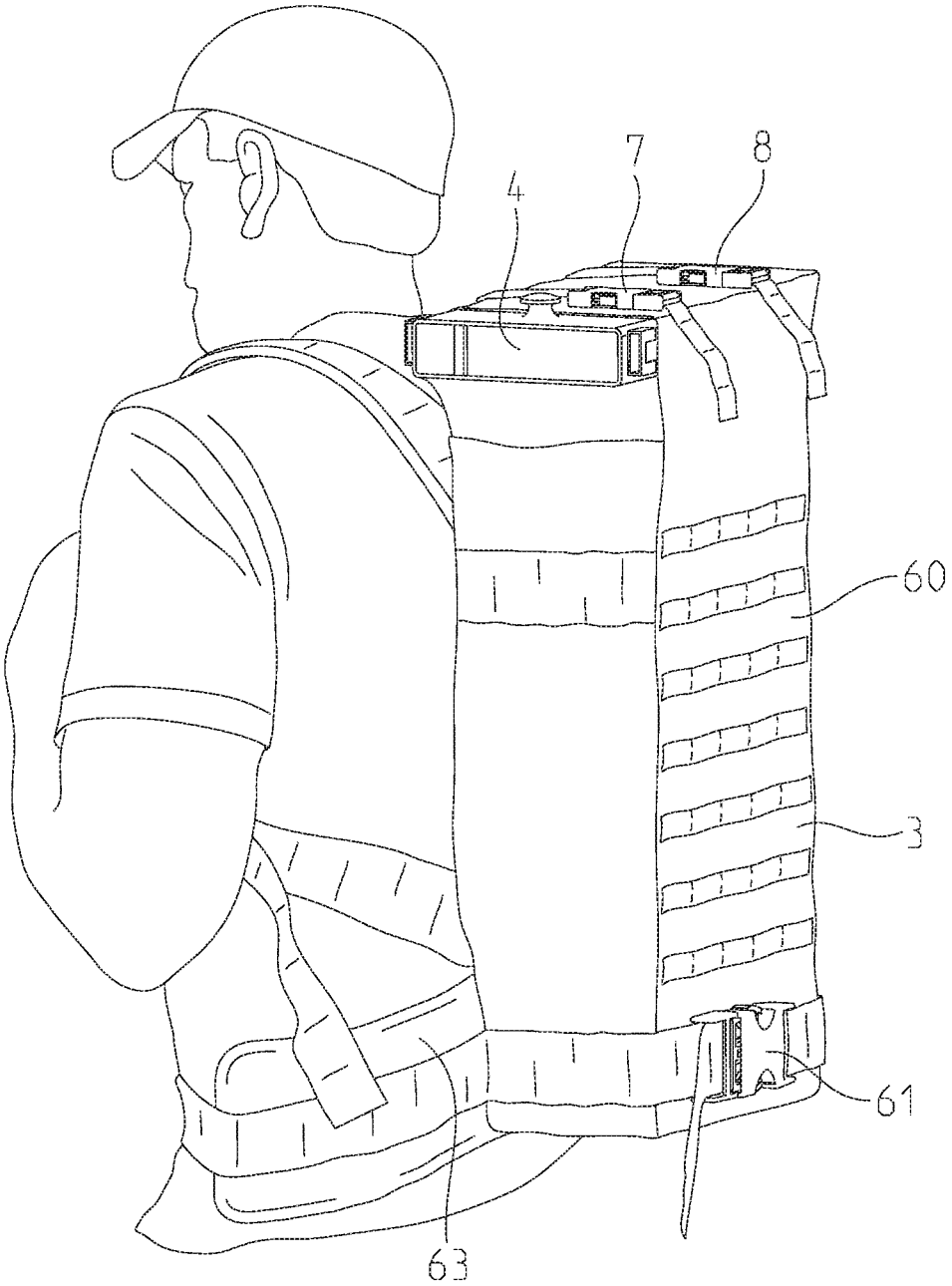
FIG. 11 shows a perspective side view of an operator wearing an alternative embodiment of a frameless exemplary carrier and feed system in accordance with one embodiment of the invention with a feed chute removed thus showing a feed chute adapter.
Figure 12:
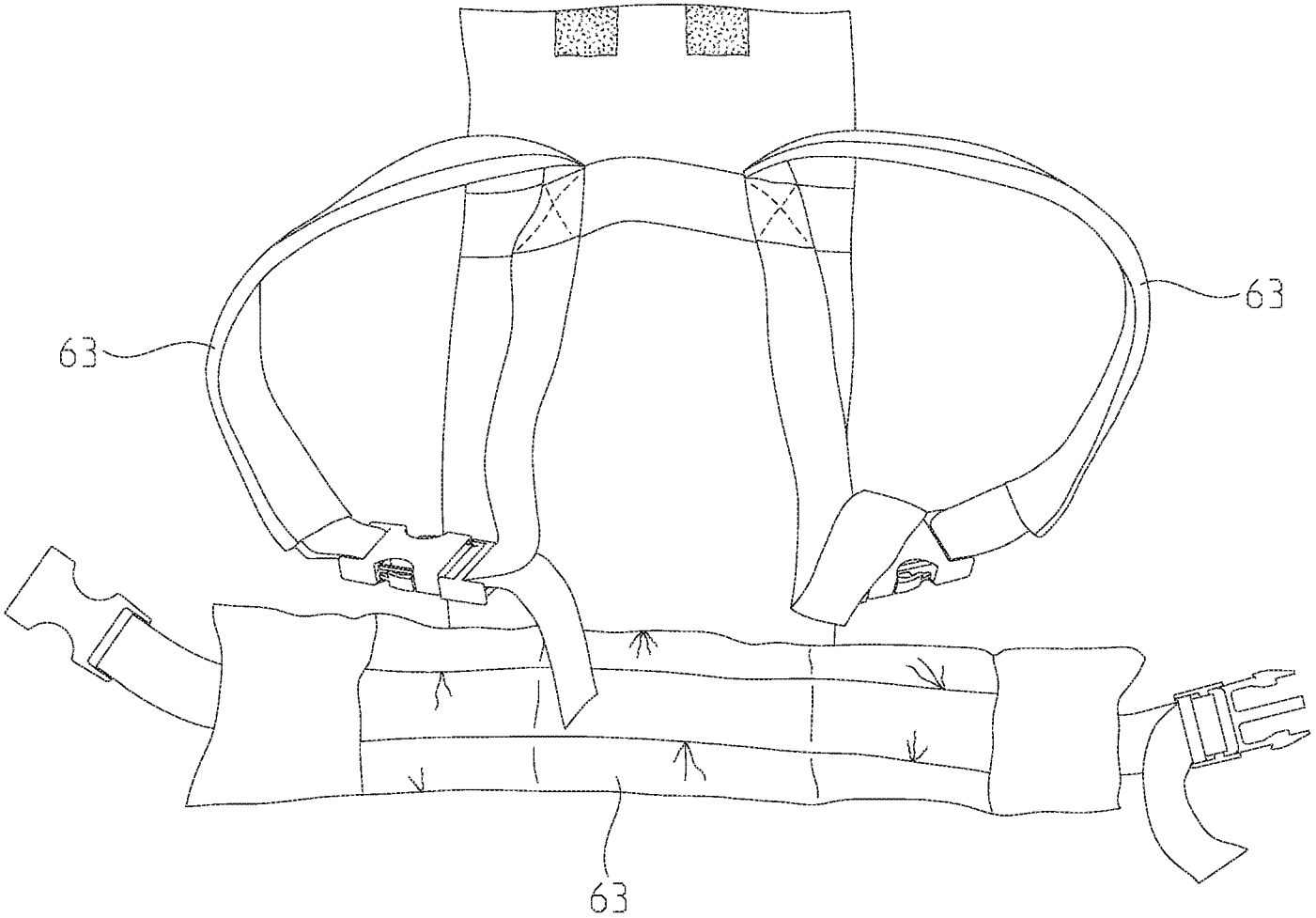
FIG. 12 shows a view of another view of the of FIG. 11 embodiment which shows straps and a waist band/strap.

FIG. 11 shows a perspective side view of an operator wearing an alternative embodiment of a frameless exemplary carrier and feed system in accordance with one embodiment of the invention with a feed chute removed thus showing feed chute adapter 4. Backpack straps 63 are coupled directly to alternate embodiment flexible outer container 60 so as to keep the system higher on an operator body versus more on the operator's hips. A lower quick release strap 61 is provided on a bottom section which couples with a lower section of the backpack strap section 63. Upper quick release clips 7 and 8 close a top section of the flexible outer container 60 and thus close the top section to retain an exemplar carrier and feed structure such as, e.g., discussed above. FIG. 12 shows another view of the FIG. 10 embodiment which shows multiple backpack straps 63 including shoulder straps and a waist band/strap.

A method of operating or use can include providing a system such as discussed above, disposing a flexible belt of items or consumables within the system so that the belt is folded over divider 47 (e.g., see FIG. 10) so as a middle section of the belt is elevated from a floor section of the carrier and feed structure 19, coupling or attaching the feed chute 2 with an equipment item that utilizes the items or consumables. In other words, one natural use of an exemplary belt of items by an equipment item, e.g., firearm, nail gun, additive manufacturing system, integrated circuit (IC) package installer, robotic repair system with different repair parts in belt form, etc. will pull the next item automatically. For example, a firearm that fires projectiles disposed within the belt, and operating the equipment item such that the equipment item pulls on the belt, utilizes the items or consumables, and pulls the belt through the feed chute, feed chute adapter, and from the carrier and feed structure 19 interior.

An alternate embodiment of the invention can include use with an additive manufacturing system that is portable which permits additive manufacturing items to be retrieved from the carrier system for use in a portable system. Embodiments of a flexible belt with, e.g., additive manufacturing cartridges, can use additive manufacturing feed or dispensing material e.g. powder, paste, etc. A belt of the same or different dispensing articles or modules can be provided in the carrier that is flexibly coupled. Such exemplary embodiments can include a portable manufacturing system which uses a portable additive manufacturing system which receives different additive manufacturing consumable cartridges which are fed into an additive manufacturing system for use in the portable system. Other alternative embodiments can include automated mobile repair systems which have belt or ribbon coupled parts or consumable items. Additional embodiments can include a system that has different parts or components that are associated with different locations of a belt or ribbon system that holds the parts or components as well as a controller system coupled to either the carrier or feed structure that tracks location of such items as well as expenditure of such items by a coupled equipment item which is consuming or using such parts or components. Such embodiments can include a protective cover or layer formed over belts or ribbons of such items, parts, or consumables which facilitate passage of different items through the feed chute to include a layer of Teflon® or other material which reduces friction between belt items and the feed chute or other elements of an exemplary system.

Such a layer can also be formed on one or more parts of the carrier or feed structure to also reduce friction from belt or ribbon structures passing through or past different sections of the carrier or feed structure.

Although the invention has been described in detail with reference to certain preferred embodiments, variations and modifications exist within the spirit and scope of the invention as described and defined in the following claims.

The invention claimed is:

1. A carrier and feed system comprising:

a carrier and feed structure comprising an enclosure having a floor, four sides attached to said floor on one end of each said sides, said four sides comprising a first, a second, a third and a fourth side, and an opening in an upper section opposing said floor section, wherein said carrier and feed structure is formed from a non-metallic semi-rigid material, wherein said first and third sides are disposed opposite to one another and said second and fourth sides are disposed opposite to one another;

a lid section rotatably coupled with said upper section on said first and third side so as to cover said opening using a hinge coupler, said lid section further comprising a first quick release structure disposed on one end of said lid section comprising a flexible tension latch;

a divider support section comprising a flat section formed with a first width and height, said divider coupled to a middle section of said floor and extending perpendicular to said floor a first predetermined distance away from said upper section, said divider is coupled to two opposing sides of said carrier and feed structure at a middle section of said sides between said opening and said floor on one end;

a feed structure disposed and coupled on and with said fourth side on an upper end, wherein the feed structure is approximately perpendicular to the fourth side and parallel to the floor section, wherein the first quick release structure is configured to couple to the feed structure;

a feed chute configured to carry a plurality of items carried within said carrier in a belt form through said feed chute, said feed chute is coupled or attached to the feed structure by a feed chute adapter section comprising a clip receiving sections that engage one end of said feed chute with clips on said feed structure, an opposing end of said feed structure comprises a second feed chute adapter section that is configured for coupling with an equipment item that receives and utilizes the plurality of items or consumables, wherein the plurality of items or consumables pass through the feed structure and feed chute approximately perpendicular to the fourth side and parallel to the floor section, wherein a top wall of the feed chute supports the plurality of items or consumables and prevents the plurality of items or consumables from being pulled away from the carrier and feed structure when the lid section is in an open position;

a latch coupler disposed on or near said carrier and feed structure configured to engage with said first quick release structure;

a flexible outer container formed with a first, second, and third portion, wherein said first portion is a bottom section, said second portion is formed with two flaps on a top section of said flexible outer container, and said third portion is an enclosing circular structure that is formed between and couples with said first and second portions so as to provide a bag type structure with an opening formed by said two flaps, wherein said two flaps are formed with a plurality of coupling structures comprising second and third quick release structures, said carrier and feed structure is disposed within said flexible outer container; and a harness section configured to couple said flexible outer container with a mobile structures;

wherein the lid section is in a closed position when the first quick release structure is coupled to the feed structure and the lid section is in the open position when the first quick release structure is not coupled to the feed structure;

wherein the feed chute is configured to carry a plurality of items carried within said carrier in a belt form through said feed chute when the lid section is in both the open position and the closed position.

2. A carrier as in claim 1 wherein said non-metallic semi-rigid material comprises thermoplastic material.

3. A carrier as in claim 1, wherein said harness section further comprises a frame disposed in contact with one external side of said flexible structure and a plurality of frame straps or coupling structures, wherein said outer flexible container further comprises mounting loops through which a plurality of said frame straps or coupling structures pass to couple with said frame.

4. A carrier as in claim 1, wherein said equipment item comprises a belt engagement section that is configured to engage with said belt comprising said items so as to pull said items from said carrier.

5. A carrier as in claim 4, wherein said equipment item comprises a firearm that fires items comprising projectiles disposed within the belt, and operating the equipment item such that the equipment item pulls on the belt, utilizes the items or consumables, and pulls the belt through the feed chute, feed chute adapter, and from the carrier and feed structure interior, wherein said divider support section is formed so that said first predetermined distance is a width of folded over said projectiles disposed within said belt which is folded a plurality of times over said divider support section so folds of said belt are disposed on opposing sides of said divider support section.

6. A carrier as in claim 1, wherein sections of said carrier and feed system are secured using fasteners.

7. A carrier as in claim 1, wherein said divider is secured to said opposing sides with a securing bolt and nut that passes through two of said opposing sides.

8. A manufacturing system as in claim 1, wherein said equipment item is configured to consume said items so as to pull said items from said carrier and feed structure.

9. A manufacturing system as in claim 8, wherein said equipment item is a firearm that fires items comprising projectiles disposed within the belt, and operating the equipment item such that the equipment item pulls on the belt, utilizes the items or consumables, and pulls the belt through the feed chute, feed chute adapter, and from the carrier and feed structure interior.

10. A manufacturing system as in claim 8, wherein said equipment item is an additive manufacturing system and said items comprise additive manufacturing consumable cartridges.

11. A carrier as in claim 1, wherein the divider support section is removably coupled to the said carrier and feed structure.

12. A manufacturing system including a carrier and feed system comprising:

a carrier and feed structure configured for carrying and feeding a plurality of manufacturing consumable modules to a manufacturing system formed into a belt structure, said carrier and feed structure comprising an enclosure having a floor, four sides attached to said floor on one end of each said sides, said four sides comprising a first, a second, a third and a fourth side, and an opening in an upper section opposing said floor section, wherein said carrier and feed structure is formed from a non-metallic semi-rigid material, wherein said first and third sides are disposed opposite to one another and said second and fourth sides are disposed opposite to one another;

a lid section rotatably coupled with said upper section on said first and third side so as to cover said opening using a hinge coupler, said lid section further comprising a first quick release structure disposed on one end of said lid section comprising a flexible tension latch, wherein the first quick release structure is configured to couple to the feed structure;

a divider comprising a flat section formed with a first width and height, said divider coupled to a middle section of said floor and extending perpendicular to said floor, said divider is coupled to two opposing sides of said carrier and feed structure at a middle section of said sides between said opening and said floor on one end;

a feed structure disposed and coupled on and with said fourth side on an upper end, wherein the feed structure is approximately perpendicular to the fourth side and parallel to the floor section;

a feed chute configured to carry a plurality of items carried within said carrier in a coupled or linked belt form, said feed chute is coupled or attached to the feed structure by a feed chute adapter, said feed structure is selectively coupled with an equipment item that utilizes the plurality of items or consumables during operation, wherein the plurality of items or consumables pass through the feed structure and feed chute approximately perpendicular to the fourth side and parallel to the floor section, wherein a top wall of the feed chute supports the plurality of items or consumables and prevents the plurality of items or consumables from being pulled away from the carrier and feed structure when the lid section is in an open position;

a latch coupler disposed on or near said feed structure configured to engage with said first quick release structure;

a flexible outer container formed with a first, second, and third portion, wherein said first portion is a bottom section, said second portion is formed with two flaps on a top section of said flexible outer container, and said third portion is an enclosing circular structure that is formed between and couples with said first and second portions so as to provide a bag type structure with an opening formed by said two flaps, wherein said two flaps are formed with a plurality of coupling structures comprising second and third quick release structures, said carrier and feed structure is disposed within said flexible outer container; and a backpack strap section configured to couple with said flexible outer container and further comprises straps configured to couple with a mobile structures;

wherein the lid section is in a closed position when the first quick release structure is coupled to the feed structure and the lid section is in the open position when the first quick release structure is not coupled to the feed structure;

wherein the feed chute is configured to carry a plurality of items carried within said carrier in a belt form through said feed chute when the lid section is in both the open position and the closed position.

13. A manufacturing system as in claim 12 wherein said non-metallic semi-rigid material comprises thermoplastic material.

14. A manufacturing system as in claim 12, wherein said outer flexible container further comprises fastened mounting loops through which a plurality of frame straps pass to couple with a backpack frame structure.

15. A manufacturing system as in claim 12, further comprising said plurality of manufacturing consumable modules to said manufacturing system formed into said belt structure.

16. A manufacturing system as in claim 12, wherein said manufacturing consumable modules comprises additive manufacturing feed or dispensing materials and a dispensing structure configured to provide said feed or dispensing materials to an additive manufacturing system.

17. A manufacturing system as in claim 12, further comprising an automated mobile or stationary structure said carrier and feed structure is positioned on using said straps.

18. A manufacturing system as in claim 17, wherein said automated mobile or stationary structure comprises at least two armatures adapted to carry said additive manufacturing system, said additive manufacturing system is configured to receive said manufacturing consumable modules through said feed structure of said carrier and feed system.

19. A manufacturing system as in claim 12, wherein sections of said carrier and feed system are secured using selectively releasable fasteners.

20. A manufacturing system as in claim 12, wherein said divider is secured to said opposing sides using a securing bolt that passes through two of said opposing sides.

21. A manufacturing system as in claim 12, wherein the divider is removably coupled to the said carrier and feed structure.

* * * * *